US006447703B1

(12) United States Patent
Waddington et al.

(10) Patent No.: US 6,447,703 B1
(45) Date of Patent: Sep. 10, 2002

(54) PROCESSES AND SYSTEMS FOR MAKING SYNTHETIC BULKED CONTINUOUS FILAMENT YARNS

(75) Inventors: David M. Waddington, Easley; Ann S. Johnson, Central, both of SC (US); Randall A. Sferrazza, Asheville, NC (US)

(73) Assignee: BASF Corporation, Mount Olive, NJ (US)

( * ) Notice: Subject to any disclaimer, the term of this patent is extended or adjusted under 35 U.S.C. 154(b) by 186 days.

(21) Appl. No.: 09/599,458

(22) Filed: Jun. 22, 2000

(51) Int. Cl.[7] ..... D01D 5/16; D01D 13/00; D01F 6/60; D02G 3/02

(52) U.S. Cl. ..... 264/103; 28/247; 28/271; 264/210.8; 264/211.12; 264/211.14; 425/66; 425/72.2; 425/104; 425/377; 425/379.1; 425/382.2; 425/445; 425/464

(58) Field of Search ..... 264/103, 210.8, 264/211.12, 211.14; 425/66, 72.2, 104, 377, 379.1, 382.2, 445, 464; 28/247, 271

(56) References Cited

U.S. PATENT DOCUMENTS 3,781,949 A 1/1974 Breen et al.
4,096,226 A 6/1978 Martin et al.
4,319,388 A 3/1982 Champaneria et al.
4,522,774 A 6/1985 Donnelly et al.
4,993,130 A 2/1991 Coons, III et al.
5,060,345 A 10/1991 Coons, III et al.
5,487,860 A 1/1996 Kent et al.
5,804,115 A 9/1998 Burton et al.
6,113,825 A * 9/2000 Chuah ..... 264/103

* cited by examiner

*Primary Examiner*—Leo B. Tentoni
(74) *Attorney, Agent, or Firm*—Nixon & Vanderhye P.C.

(57) ABSTRACT

Processes and apparatus are provided whereby the morphology of bulked continuous filament (BCF) yarns can be variably controlled. More specifically, according to the present invention, the BCF yarn is melt-spun, drawn and textured, most preferably in a one-step spin-draw-texture (SDT) process, wherein prior to texturing, the yarn is subjected to a differential temperature condition. Most preferably, such differential temperature condition is accomplished using the duo rolls employed in drawing the BCF, such that one of the rolls is maintained at a greater temperature as compared to the other of the rolls. Most preferably, it is the upstream-most roll (relative to the general conveyance path of the filament toward the texturizer) which is the hotter of the duo rolls.

17 Claims, 4 Drawing Sheets

PROCESSES AND SYSTEMS FOR MAKING SYNTHETIC BULKED CONTINUOUS FILAMENT YARNS

FIELD OF THE INVENTION

Figure 1:
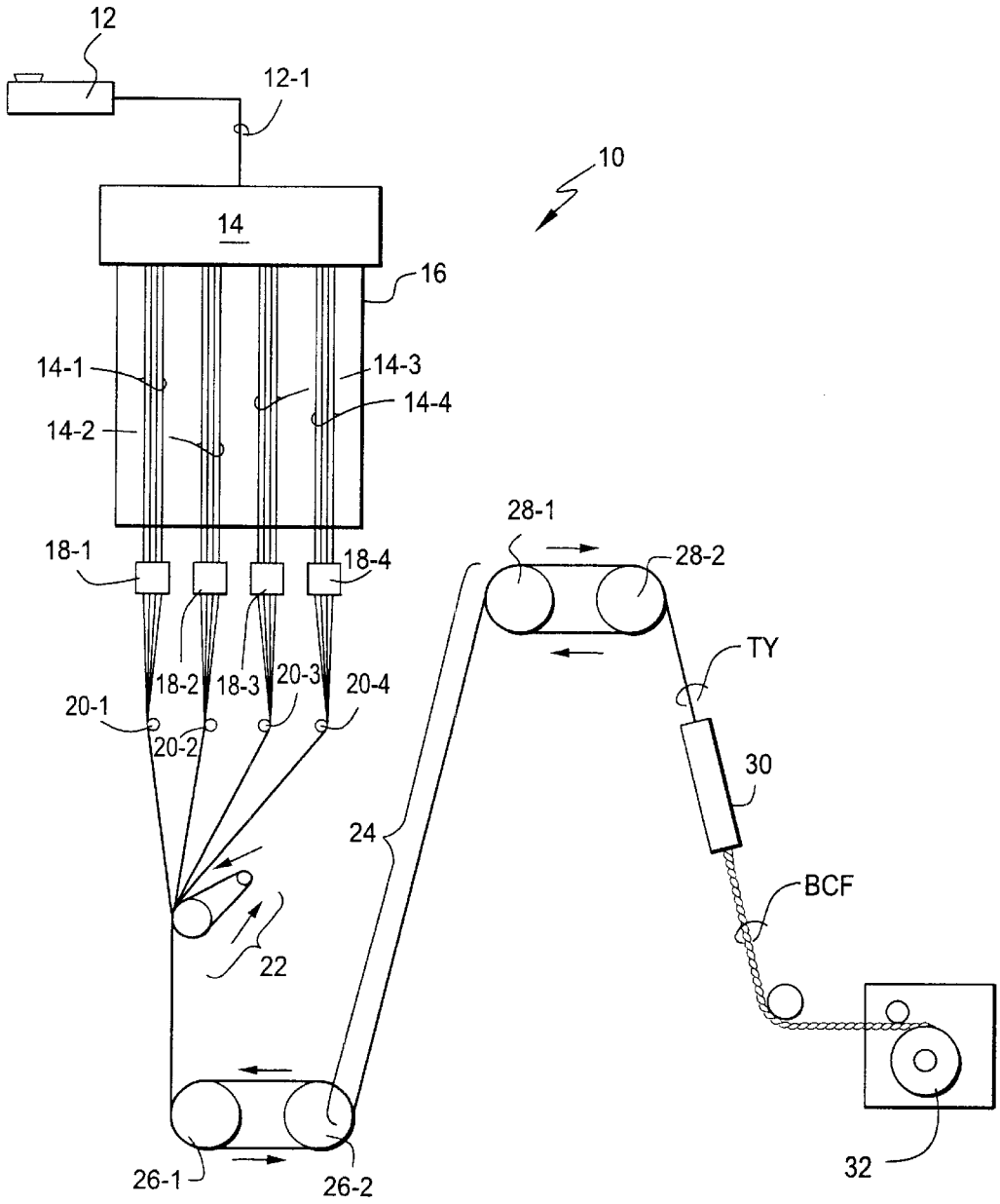
Figure 2B:
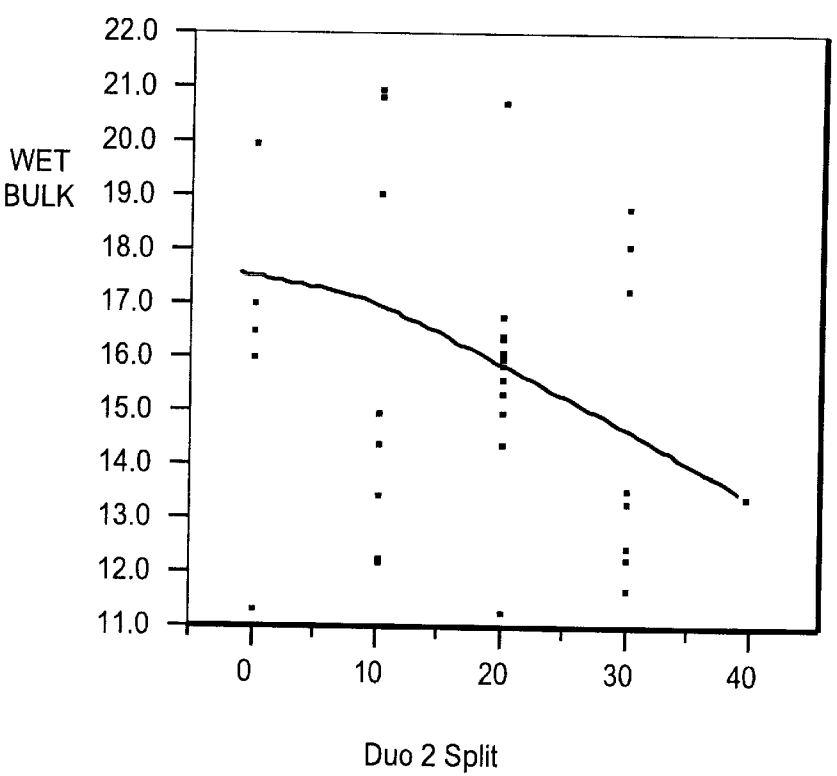
Figure 2A:
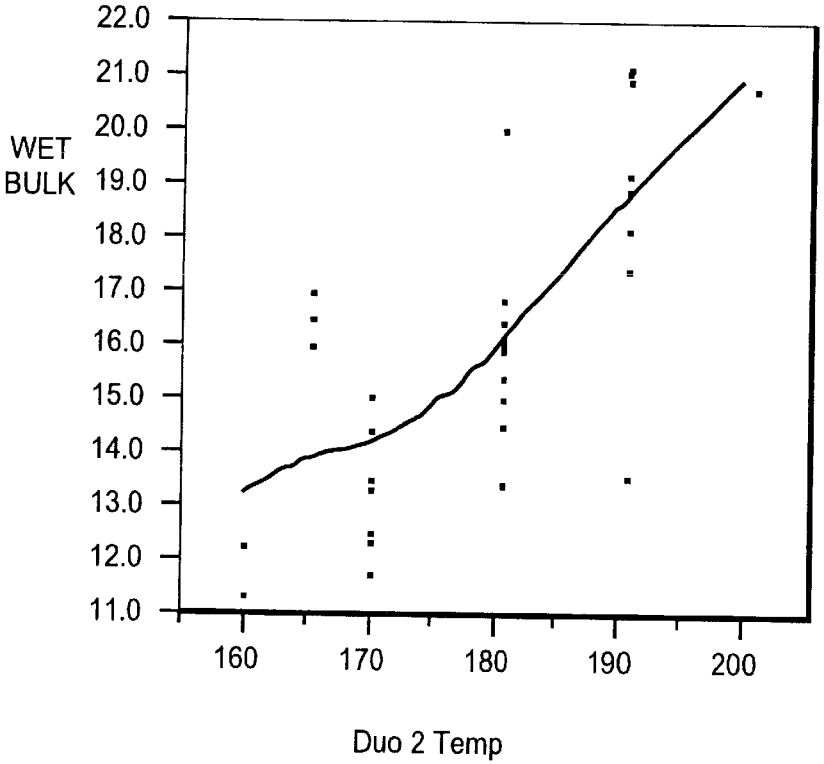
Figure 3B:
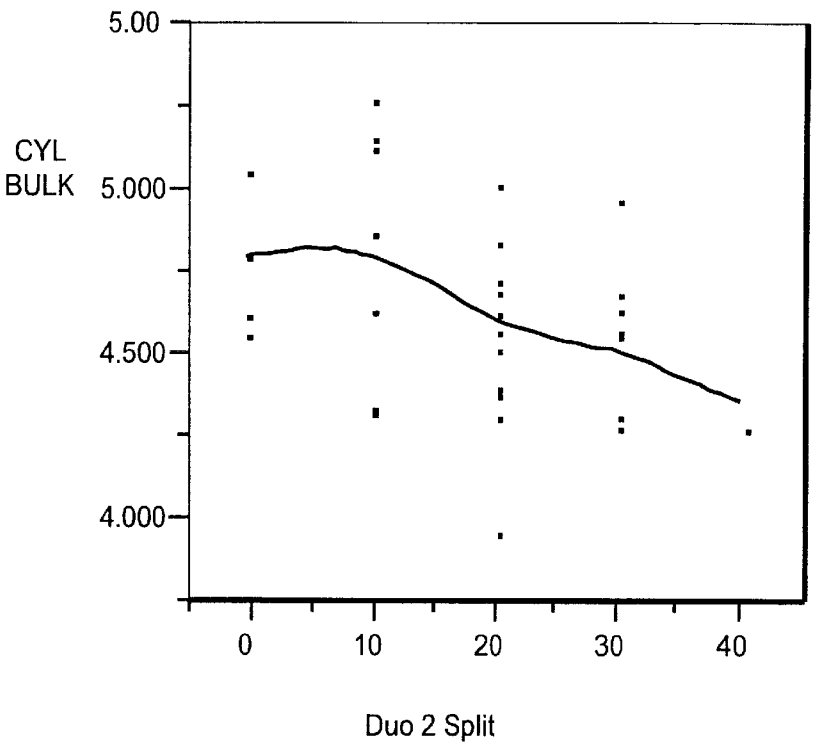
Figure 3A:
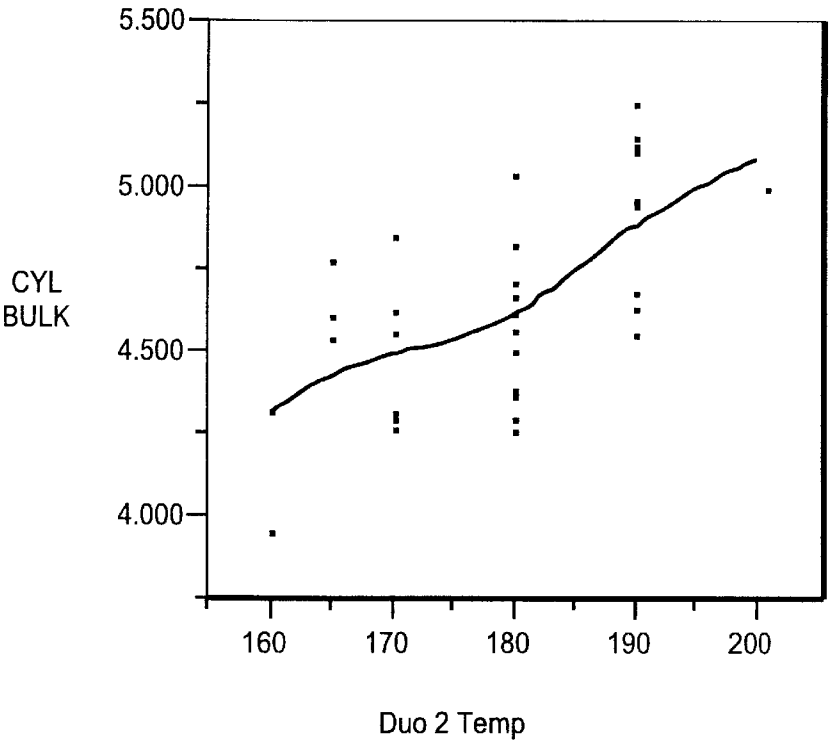
Figure 4B:
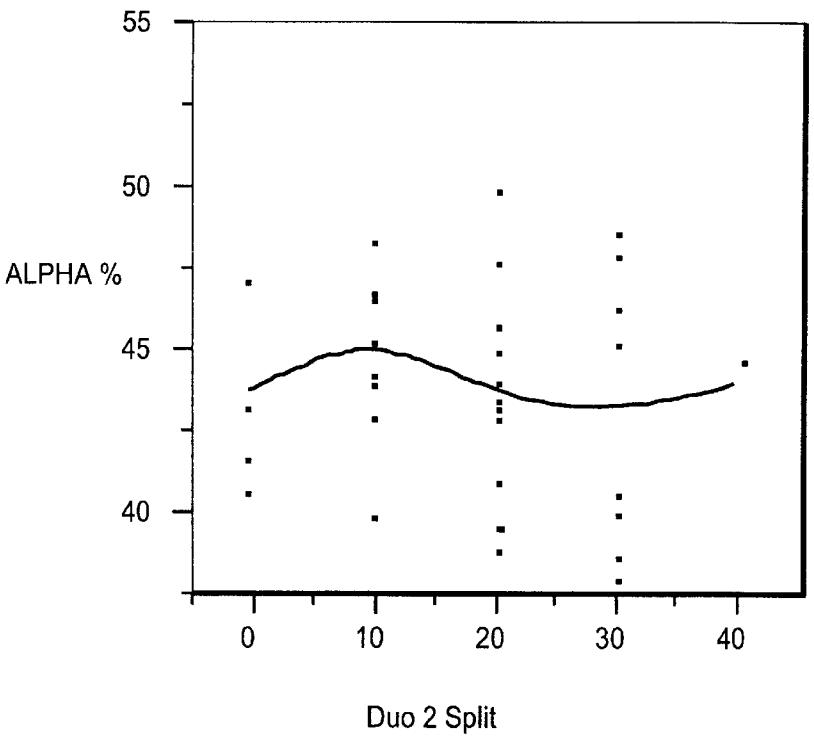
Figure 4A:
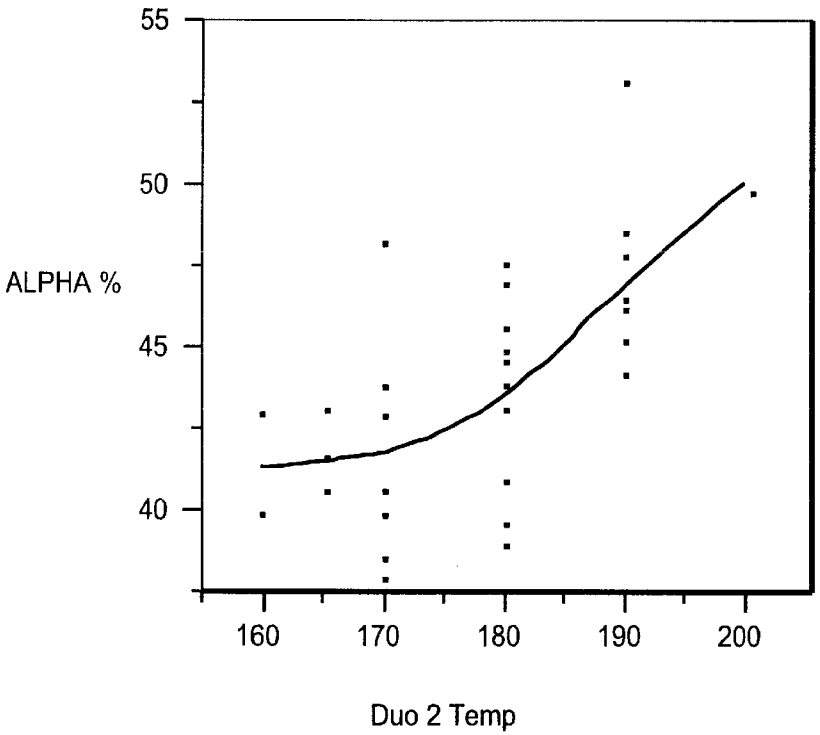

The present invention relates generally to synthetic filaments and to their processes and systems for manufacture. More specifically, the present invention relates to processes and systems for making melt-spun, synthetic polymeric yarns of bulked continuous filaments (BCF).

BACKGROUND AND SUMMARY OF THE INVENTION

I. Definitions

As used herein, certain terms have the following meanings:

"Filament" or "filaments" mean fibrous strands of extreme or indefinite length. In contrast, "staple fibers" mean fibrous strands of definite and short lengths.

"Yarn" means a collection of numerous filaments which may or may not be entangled, twisted or laid together.

"One-step" means a process for making yarn where the yarn is not wound-up between spinning, drawing and texturing.

"Texturing" means any operation on filaments which results in crimping, looping or otherwise modifying such filaments to increase cover, resilience, bulk or to provide a different surface texture or hand. A "bulked continuous filament" is therefore a "filament" which has been subjected to one or more "texturing" operation(s).

II. Background of the Invention

One-step processes for manufacturing melt-spun polymeric yarns of bulked continuous filaments (BCF) are known as evidenced by the following U.S. Pat. Nos.: 5,804,115; 5,487,860; 4,096,226; 4,522,774; and 3,781,949 (the entire content of each cited U.S. Patent being incorporated expressly hereinto by reference). In general, such processes involve the continuous sequential operations (i.e., without any intermediate winding of the yarn) of spinning, drawing and texturing. The resulting BCF yarn is thereafter wound on a package either sold as is or subjected to further processing (e.g., coloration, entangling with other yarns, fabric formation, and the like).

Conventional one-step BCF yarn production techniques typically involve the melt-spinning of multiple polymeric filament streams which, when cooled form the precursor (or undrawn) filaments of the later BCF yarn. These undrawn filaments are then typically immediately directed to separated pairs of godet rolls (sometimes referred to as "duos" in art parlance) operating at different rotational speeds. The BCF yarn will therefore be drawn between such duos at a desired draw ratio dependent on the duo speed differential, yarn temperature, yarn speed and the like. The duos are typically heated to the same temperature in order to elevate the filament temperature prior to texturing.

The thus drawn and heated yarn is then subjected to a texturing operation, usually accomplished by feeding the drawn continuous filament yarn into a fluid jet texturing unit at a rate faster than the rate at which the textured yarn is drawn off and subjecting the yarn in the unit to a turbulent region of a fluid jet, usually at elevated temperature (e.g., a so-called fluid jet texturing method). The resulting textured continuous filament yarn exhibits increased bulk as compared to the non-textured yarn being fed into the texturing unit to achieve the BCF yarn which may then be wound up to form a yarn package.

III. Summary of the Invention

Broadly, the present invention is embodied in processes and apparatus whereby the morphology of BCF yarns can be variably controlled. More specifically, according to the present invention, the BCF yarn is melt-spun, drawn and textured, wherein prior to texturing, the yarn is subjected to differential temperature condition. Most preferably, such differential temperature condition is accomplished using the duo rolls employed in drawing the BCF, such that one of the rolls is maintained at a greater temperature as compared to the other of the rolls. Most preferably, it is the upstream-most roll (relative to the general conveyance path of the filament toward the texturing unit) which is the hotter of the duo rolls.

These and other aspects and advantages will become more apparent after careful consideration is given to the following detailed description of the preferred exemplary embodiments thereof.

BRIEF DESCRIPTION OF THE ACCOMPANYING DRAWINGS

Reference will hereinafter be made to the accompanying drawings, wherein like reference numerals throughout the various FIGURES denote like structural elements, and wherein;

FIG. 1 schematically represents a preferred system in accordance with the present invention; and FIGS. 2A–2B, 3A–3B and 4A–4B each represent graphical forms of data obtained from the Examples below.

DETAILED DESCRIPTION OF THE INVENTION

Accompanying FIG. 1 schematically represents a particularly preferred system 10 in accordance with the present invention. In this regard, a conventional extruder 12 supplies molten polymeric material via line 12-1 to a spinning head 14. The spinning head 14 includes spinnerettes (not shown) having multiple small orifices through with the molten polymer material is extruded to form streams 14-1, 14-2, 14-3 and 14-4 which are cooled and solidified in the quench chamber 16 to form corresponding multi-filament yarns. The now solidified yarns 14-1 through 14-4 may brought into contact with a finish applicator 18-1, 18-2, 18-3 and 18-4, respectively, whereby a liquid finish is applied onto the surface of the yarns as may be desired.

It should be noted here that four yarns are shown only for the purpose of illustration. Thus, more or less yarns may be spun as desired for the finished yarn product.

The yarns 14-1 through 14-4 are then guided by guides 20-1, 20-2, 20-3 and 20-4 to a pretensioner godet 22. The pretensioner godet 22 serves to prevent slippage of the filaments on the draw rolls and stabilized filament movement. The pretensioned yarns are then drawn in a draw zone 24 between separated pairs of duos 26-1, 26-2 and 28-1, 28-2, respectively. The tensioned yarns (now collectively identified by TY in FIG. 1) may then be separately or collectively subjected to texturing by a conventional texturing unit 30. Most preferably, texturing unit 30 is a fluid jet texturizer wherein a fluid jet at elevated temperature is brought into contact with the drawn yarns to texturize the same. The textured BCF yarns (identified by BCF in FIG. 1) are then wound into a yarn package via winder 32.

In accordance with the present invention, the duo rolls 28-1, 28-2 are heated to a desired differential temperature (sometimes hereinafter referred to as "split"). Thus, unlike the conventional practice of maintaining the duo rolls 28-1 and 28-2 at substantially the same elevated temperature, one of the rolls 28-1 or 28-2 will be at a greater temperature as compared to the other of the rolls 28-1 or 28-2. Although the precise temperature differential employed will depend upon a variety of factors, including for example, the desired a-crystal structure of the filaments, subsequent fluid jet temperature, desired wet bulk, and the like, it is preferred that the duos exhibit a temperature differential of greater than about 10° C. The temperature differential should preferably be no more than about 40° C., and typically no more than about 30° C. Most preferably, it is the upstream-most roll (e.g., roll 28-1 as shown in FIG. 1) relative to the texturing unit 30 that is the hotter of the rolls 28-1, 28-2. At such temperature differentials, the wet bulk of the BCF yarn will typically be less than about 25%, and usually between about 10% to about 20%. Wet bulk of between about 13%–19% is especially preferred for BCF carpet yarns.

By way of example, it is desired to produce a BCF yarn having about 16.5% wet bulk and as high an α-crystal content as possible. If the temperature of the duo rolls 28-1 and 28-2 were constant, then a temperature of about 168° C. would be required. Such a condition would result in a maximum a-crystal content of about 45%. According to the present invention, however, the α-crystal content can be increased by using a temperature differential (or "split") between the duo rolls 28-1 and 28-2 wherein one roll is at a temperature of about 190° C. and the other roll is at a temperature of about 160° C. The resulting BCF would then exhibit an α-crystal content of about 53%. The temperature split could be even greater, for example, 198° C. for one of the rolls 28-1, 28-2 and 148° C. for the other of the rolls 28-1, 28-2 to achieve an even greater α-crystal content, but a practical upper limit of split temperature exists wherein the yarn would begin to stick to the rolls during a spinning interruption.

The filaments may be formed of any synthetic fiber-forming melt-spinnable materials, especially polyesters, polyamides and polyolefins. Suitable polyesters include (but are not limited to) polyethylene terephthalates, polybutylene terephthalates, polytrimethylene terephthalates and copolymers and mixtures thereof. Suitable polyamides include (but are note limited to) nylon 6, nylon 6, 6, nylon 6, 9, nylon 6, 10, nylon 6, 12, nylon 11 nylon 12 and copolymers and mixtures thereof. Suitable polyolefins include polypropylene, polypropylene derivatives and copolymers and mixtures thereof.

The present invention will be further understood by reference to the following non-limiting Examples.

EXAMPLES

In the following Examples, the "wet bulk", "cylinder bulk" and "alpha %" data were obtained as follows:

Wet Bulk: "Wet bulk" of a BCF yarn is determined by immersing a length of the BCF yarn tensioned with a weight of 1.35 grams in water at an elevated temperature of 70° C. for about 30 seconds. The wet bulk represents the percent contraction of the BCF yarn which is calculated using the starting length of the BCF yarn and the length of the BCF yarn after being immersed in the elevated temperature water.

Cylinder Bulk: "Cylinder bulk" (sometimes abbreviated "cyl bulk") of a BCF yarn is the specific volume (cc/gm) of a yarn sample under a compression load of about 9 kg. The cylinder bulk is determined by compressing, within a PTFE cylinder using the compression rod of an Instron gage, under a compression load of about 9 kg, a yarn sample weighing 5 grams which has been boiled previously in water for 30 minutes and allowed to dry.

Alpha %: "Alpha %" is the percent of alpha crystallinity in the BCF yarn is determined by infrared spectrometry with a photoacoustic detector and a wire grid polarizer to collect spectral data.

The alpha % represents the percent alpha crystallinity of an average of several yarn samples using their respective peak heights at two characterized frequencies for known alpha and gamma crystal absorbances.

A single position RIETER JO/10 SDT machine similar to that depicted schematically in FIG. 1 was used to run samples of BCF nylon 6 (ULTRAMID® nylon commercially available from BASF Corporation) yarns at different combinations of duo 2 temperatures, texturing air temperature and texturing block heat. The individual rolls of the duo 2 (corresponding to duo rolls 28-1 and 28-2 in FIG. 1) were varied to yield different temperature differences. For the purposes of these examples, the term "duo 2 temperature" is defined as the temperature of the hotter roll, and the term "duo 2 split" is defined as the absolute temperature difference (ΔT) between the hotter and cooler roll. Wet bulk, cylinder bulk and alpha % data were obtained and plotted against each of the duo 2 temperature and duo 2 split and appear as FIGS. 2A–2B, 3A–3B and 4A–4B, respectively.

As can be seen from such FIGURES, the "bulk" of the BCF yarn (i.e., as evidenced by the wet bulk and cylinder bulk) increased with an increase in the duo 2 temperature. Similarly, a decrease in the duo 2 split (i.e., a hotter roll temperature) resulted in increased bulk. Such an effect is apparent from FIGS. 2A–2B, and 3A–3B.

However, the data reveal a different result for the percentage of alpha crystals in the filaments. Specifically, for the duo 2 temperature (texturing air temperature and block heater temperature as well), the alpha crystal content increases with temperature. However, there is not an effect of the duo 2 temperature split on the alpha content. This effect is apparent from FIGS. 4A–4B.

Therefore, the data show that, by choosing the combination of the duo 2 temperature, texturing air temperature and block heater temperature, a desired level of crimp can be made in the yarn. For a high crimp (high bulk) yarn, this will require high temperatures and the alpha crystal structure is preferred. For a low crimp (low bulk) yarn, if the temperatures were lowered, then gamma crystals would predominate. However, by increasing the split between the roll temperatures for the duo 2, then low bulk can be maintained, with predominantly alpha crystals.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A process for making a polyamide yarn of bulked continuous filaments (BCF) comprising the steps of:

(a) melt-spinning a polyamide material to form multiple filaments thereof followed sequentially by drawing and texturing the filaments to form a polyamide yarn of BCF, and (b) prior to texturizing, subjecting the drawn polyamide yarn of BCF to a differential temperature condition sufficient to achieve a greater alpha-crystallinity prior to texturizing the yarn and a lesser wet bulk after texturizing the yarn as compared to polyamide yarn not subjected to said differential temperature condition.

2. The process of claim 1, wherein step (b) is practiced using a pair of rolls, wherein one of the rolls has a greater temperature condition as compared to a lesser temperature condition of the other roll.

3. The process of claim 2, wherein the one roll which has the greater temperature condition is upstream of the other roll with the lesser temperature condition.

4. The process of claim 1, 2 or 3, wherein the temperature differential is greater than about 10° C.

5. The process of claim 4, wherein the temperature differential is between about 10° C. to about 40° C.

6. The process of claim 4, wherein the temperature differential is between about 10° C. to about 30° C.

7. The process of claim 4, wherein the BCF has a wet bulk of less than about 25%.

8. The process of claim 4, wherein the BCF has a wet bulk of between about 10% to about 20%.

9. The process of claim 8, wherein the BCF has a wet bulk of between about 13% to about 19%.

10. The process of claim 1, wherein the polyamide material is nylon.

11. A system for making a polyamide yarn of bulked continuous filaments comprising:

a spinning head for melt-spinning a polymeric material to form multiple filaments thereof;

a draw zone downstream of said spinning head for drawing the melt-spun filaments; and a texturing unit downstream of the draw zone for texturizing the melt-spun, drawn filaments; wherein said draw zone includes at least a pair of rolls which are contacted by the filaments prior to being fed to the texturing unit and which are maintained at respective greater and lesser temperature conditions to thereby establish a differential temperature condition therebetween sufficient to achieve a greater alpha-crystallinity prior to texturizing the yarn in said texturing unit, and a lesser wet bulk after texturizing the yarn in said texturing unit as compared to polyamide yarn not subjected to said differential temperature condition.

12. The system of claim 11, wherein an upstream one of the pair of rolls is maintained at said greater temperature and a downstream one of said pair of rolls is maintained at said lesser temperature so as to established said temperature differential therebetween.

13. The system of claim 11 or 12, further comprising means for maintaining the differential temperature greater than about 10° C.

14. The system of claim 13, wherein the temperature differential is between about 10° C. to about 40° C.

15. The system of claim 13, wherein the temperature differential is between about 10° C. to about 30° C.

16. The system of claim 11, further comprising a finish applicator downstream of said spinning head to apply a liquid finish to the filaments.

17. The system of claim 11, further comprising a winder downstream of said texturing unit to wind the BCF yarn into a yarn package.

* * * * *